US006249176B1

(12) United States Patent
Pease

(10) Patent No.: US 6,249,176 B1
(45) Date of Patent: Jun. 19, 2001

(54) ULTRA LOW VOLTAGE CASCODE CURRENT MIRROR

(75) Inventor: Robert A. Pease, San Francisco, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/625,907

(22) Filed: Jul. 26, 2000

Related U.S. Application Data

(62) Division of application No. 09/167,101, filed on Oct. 5, 1998, now Pat. No. 6,124,753.

(51) Int. Cl.[7] ..... G05F 3/02

(52) U.S. Cl. ..... 327/538; 327/540; 323/312; 323/313

(58) Field of Search ..... 327/530, 538, 327/540, 541, 53, 66; 323/312, 313, 314, 315; 330/288

(56) References Cited

U.S. PATENT DOCUMENTS

| | | | |
|---|---|---|---|
| 4,897,596 | 1/1990 | Hughes et al. | 232/315 |
| 5,337,011 | 8/1994 | French et al. | 330/258 |
| 5,532,579 | 7/1996 | Park | 323/314 |
| 5,570,008 | 10/1996 | Goetz | 323/315 |
| 5,594,382 | 1/1997 | Kato et al. | 327/541 |
| 5,633,612 | 5/1997 | Lee | 330/288 |
| 5,874,852 | 2/1999 | Brambilla et al. | 327/538 |
| 5,955,874 | 9/1999 | Zhou et al. | 323/315 |
| 6,124,753 * | 6/2000 | Pease | 327/538 |

* cited by examiner

*Primary Examiner*—Timothy P. Callahan
*Assistant Examiner*—An T. Luu
(74) *Attorney, Agent, or Firm*—Skjerven Morrill MacPherson; Edward C. Kwok, Esq.

(57) ABSTRACT

A current source for providing matched currents at low and variable bias voltages. The current source includes a first circuit, a second circuit, and a biasing circuit. The first circuit provides a first current. The first circuit includes a first transistor with a control terminal, a first terminal, and second terminal. A second circuit provides an output current to an output node. The second circuit includes a second transistor with a control terminal, a first terminal, and second terminal. The biasing circuit includes a third transistor with a control terminal, a first terminal, and second terminal. The biasing circuit also includes a fourth transistor with a control terminal, a first terminal, and second terminal. The biasing circuit provides a voltage at the first terminal of the third transistor and a voltage at the control terminal of the second transistor so that a voltage at the first terminal of the second transistor and a voltage at the second terminal of the first transistor match. Thereby, the first current and output current approximately match.

2 Claims, 5 Drawing Sheets

ULTRA LOW VOLTAGE CASCODE CURRENT MIRROR

CROSS REFERENCE TO RELATED APPLICATION

The present application is a divisional of U.S. application Ser. No. 09/167,101, filed on Oct. 5, 1998, now issued as U.S. Pat. No. 6,124,753.

BACKGROUND

1. Field of The Invention

The present invention relates to current sources and, more specifically, to cascode current sources operable at low and variable voltages.

2. Description of The Related Art

Current sources are widely used in analog circuits. As DC biasing elements, current sources are used extensively to establish the DC bias levels within a circuit while providing low sensitivity to power supply and temperature variations of the overall circuit. Current sources are also widely used as load devices in amplifier stages. The high incremental impedance of the current mirror provides a high voltage gain of amplifier stages at low power supply voltages.

FIG. 1 illustrates a current source 20 which includes three identical PMOS transistors 22, 24, and 26 that provide currents in respective branches 21, 23 and 25. Output node N40 of branch 21 is connected to the gate and the drain terminals of NMOS transistor 10. The source terminal of NMOS transistor 10 is connected to ground. Output node N42 of branch 13 is connected to the emitter terminal of PNP transistor 11. The collector and the base terminals of transistor 11 are connected to ground. Output node N44 of branch 25 is connected to one end of resistor 12. A second end of resistor 12 is connected to ground.

Because the gate and the source terminals of transistors 22, 24 and 26 are connected to respective nodes N46 and N45, transistors 22, 24 and 26 have substantially identical gate-to-source voltages. Consequently, the major source of mismatch between the magnitudes of currents I27, I28, or I29 is caused by differences between the values of the voltage signals at output nodes N40, N42, and N44. Differences between currents at output nodes N40, N42 and N44 is also caused in part by noise or mismatches in the sizes of PMOS transistors 22, 24, or 26. The differences in current also cause voltage differences at nodes N40, N42, and N44.

To lessen the dependence of the magnitudes of currents I27, I28, and I29 on the values of voltages at respective output nodes N40, N42, and N44 and thus to achieve a good matching between the magnitudes of currents I27–I29, it is desirable that the small signal output impedance of output nodes N40, N42, and N44 be high. A conventional technique for increasing the output impedance of a current source is to use a cascode configuration.

FIG. 2 illustrates a three-branch cascode current source 60 that is similar to current source 20 of FIG. 1, except that current source 60 uses cascode transistors 13, 14, and 15 in branches 21, 23, and 25, respectively. An input biasing circuit 40 establishes a voltage at node N50 less than the voltage at node N45. Transistors 13, 14, and 15 increase the impedances at output nodes N40, N42, and N44, respectively. Thus, current source 60 provides a much improved matching among the magnitudes of currents I27, I28, and I29 compared to current source 20, shown in FIG. 1.

The cascode configuration of current source 60 achieves a good current matching when the voltage across voltage supply V1 and ground, exceeds a minimum threshold. However, the trend is that the available voltage at V1 has decreased due system designs. When the voltage at V1 falls below a minimum threshold limit, e.g. 2.0 volts, and the voltage between nodes N50 and N45 is less than V1, e.g. 1.5 volts, a voltage across the drain-to-source terminals of cascode transistors 13, 14, and 15 becomes negligible, thereby rendering current mirror 60 inoperable at low supply voltages. Thus, for acceptable operation of current source 60, more supply voltage is required than is available.

Therefore, what is needed is a current source with a high output impedance that is also capable of operating from low supply voltages.

SUMMARY OF THE INVENTION

A first embodiment provides a current source for providing matched currents at low and variable bias voltages including 1) a first circuit for providing a reference current; 2) a first transistor including a control terminal, first terminal, and second terminal, the control terminal is coupled to the first circuit; 3) a second transistor including a control terminal, first terminal, and second terminal, with a first current density, the second terminal is coupled to receive the first current; 4) a third transistor including a control terminal, first terminal, and second terminal, the control terminal is coupled to the control terminal of the first transistor and the second terminal provides a second current; 5) a fourth transistor including a control terminal, first terminal, and second terminal, with a second current density, the first terminal is coupled to receive the second current and the second terminal provides a third current to a load; 6) a fifth transistor including a control terminal, first terminal, and second terminal, the control terminal is coupled to the control terminal of the third transistor and the second terminal provides a fourth current; and 7) a bias circuit coupled to the control terminal of the fourth transistor and the second terminal of the fifth transistor for providing a voltage at the second terminal of the fifth transistor and a voltage at the control terminal of the fourth transistor so that a voltage at the first terminal of the fourth transistor and a voltage at the second terminal of the second transistor match.

The bias circuit of the current source of the first embodiment can include: a sixth transistor including a control terminal, first terminal, and second terminal, with a third current density, the control terminal is coupled to the control terminal of the fourth transistor, the second terminal is coupled to the control terminal, and the first terminal is coupled to the second terminal of the fifth transistor; a seventh transistor including a control terminal, first terminal, and second terminal, with a fourth current density, the second terminal is coupled to the control terminal of the sixth transistor and the control terminal is coupled to the second terminal of the fifth transistor; the third current density matches the second current density and the fourth current density matches the first current density.

In an embodiment, an aspect ratio of the sixth transistor is approximately 400 to 1; an aspect ratio of the seventh transistor is 20 to 5; and an aspect ratio of the fourth transistor is 400 to 1.

In an embodiment, an aspect ratio of the fourth transistor is larger than an aspect ratio of the sixth transistor.

A second embodiment provides a current source for providing matched currents at low or variable bias voltages including: a first circuit including a first transistor that includes a control terminal, a first terminal, and second terminal, that provides a first current; a second circuit including a second transistor that includes a control terminal, a first terminal, and second terminal, that is coupled to the first circuit and that provides an output current to an output node; and a biasing circuit including a third transistor that includes a control terminal, a first terminal, and second terminal and a fourth transistor that includes a control terminal, a first terminal, and second terminal, coupled to the second circuit. The biasing circuit provides a voltage at the first terminal of the third transistor and a voltage at the control terminal of the second transistor so that a voltage at the first terminal of the second transistor and a voltage at the second terminal of the first transistor match.

In an embodiment, a current density of the first transistor and the fourth transistor are approximately the same and a current density of the second transistor and the third transistor are approximately the same.

In an embodiment, an aspect ratio of the second transistor is approximately the same as an aspect ratio of the third transistor.

In an embodiment, an aspect ratio of the second transistor is larger than an aspect ratio of the third transistor.

In an embodiment, the first and fourth transistors are a first conductivity type; and the second and third transistors are a second conductivity type. The first and second conductivity types are opposite.

The present invention is better understood upon consideration of the detailed description below, in conjunction with the accompanying drawings.

BRIEF DESCRIPTION OF THE DRAWINGS

Note that use of the same reference numbers in different figures indicates the same or like elements.

DETAILED DESCRIPTION

Figure 3A:
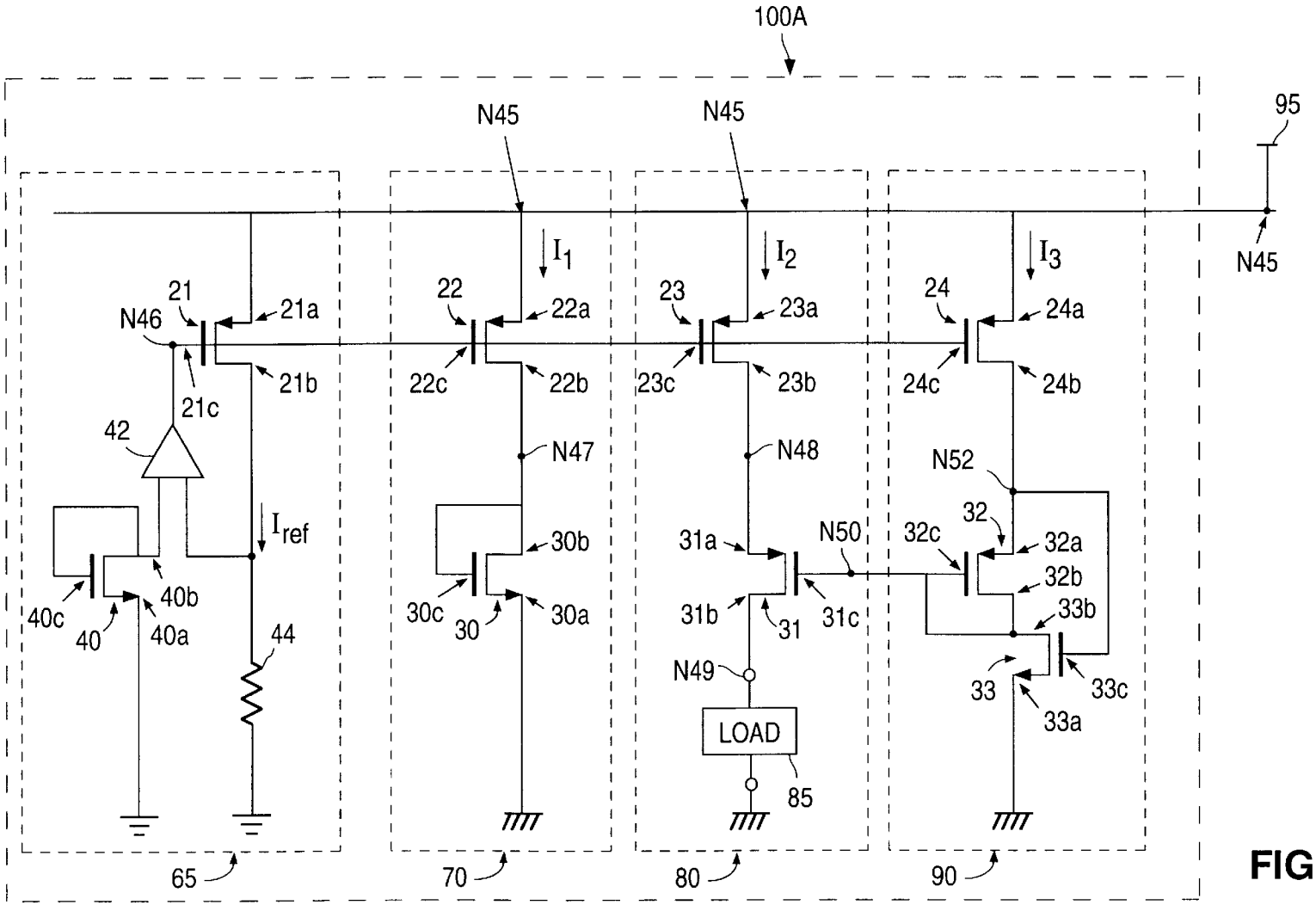
FIG. 3A illustrates a cascode current source 100A in accordance with an embodiment of the present invention.

A cascode current source 100A, in accordance with a first embodiment of the present invention is shown in FIG. 3A. Current source 100A includes conventional reference circuit 65, first output circuit 70, second output circuit 80, and biasing circuit 90. Current source 100A provides an second output current I2 to load 85 that is to be matched to current $I_{ref}$ of conventional reference circuit 65.

Conventional reference circuit 65 provides a bias voltage to node N46 and a reference current $I_{ref}$. As depicted in FIG. 3A, conventional reference circuit 65 includes operational amplifier 42, NMOS transistor 40, resistor 44, and PMOS transistor 21. Source terminal 21*a* of PMOS transistor 21 is coupled to node N45. Gate terminal 21*c* of PMOS transistor 21 is coupled to the output terminal of operational amplifier 42. Drain terminal 40*b* and gate terminal 40*c* of NMOS transistor 40 are coupled to a first input terminal of operational amplifier 42. Drain terminal 40*b* receives a suitable current from a current source not depicted. Source terminal 40*a* of NMOS transistor 40 is coupled to ground. Resistor 44 and drain terminal 21*b* of PMOS transistor 21 are coupled to a second input terminal of operational amplifier 42. In this embodiment, resistor 44 can range approximately 1 ohm to 10 megaohms. Drain terminal 21*b* of PMOS transistor 21 provides reference current $I_{ref}$.

First output circuit 70 includes a PMOS transistor 22 and an NMOS transistor 30. The source terminal 22*a*, drain terminal 22*b*, and gate terminal 22*c* of PMOS transistor 22 are connected to respective nodes N45, N47, and N46. Voltage supply 95 is applied to node N45. Drain terminal 30*b* and gate terminal 30*c* of NMOS transistor 30 are connected to node N47 and the source terminal 30*a* of transistor 30 is connected to ground. Transistor 22 generates first output current I1 that approximately replicates current $I_{ref}$ of conventional reference circuit 65.

Second output circuit 80 includes PMOS transistor 23 and PMOS transistor 31. Source terminal 23*a*, drain terminal 23*b*, and gate terminal 23*c* of PMOS transistor 23 are connected to respective nodes N45, N48, and N46. Source terminal 31*a*, drain terminal 31*b*, and gate terminal 31*c* of PMOS transistor 31 are connected to respective nodes N48, N49, and N50. Load 85 is connected between drain terminal 31*b* and ground. PMOS transistor 31 provides second output current I2 to load 85.

Biasing circuit 90 includes PMOS transistor 24, PMOS transistor 32, and NMOS transistor 33. Source terminal 24*a* is coupled to node N45. Gate terminal 24*c* is coupled to gate terminal 23*c* and gate terminal 22*c* (node N46). Drain terminal 24*b* is coupled to source terminal 32*a* of PMOS transistor 32 and gate terminal 33*c* of NMOS transistor 33, node 52. Gate terminal 32*c* and drain terminal 32*b* of PMOS transistor 32 are coupled to drain terminal 33*b* of NMOS transistor 33. Source terminal 33*a* is coupled to ground. Biasing circuit 90 provides a voltage at node N52 such that currents I1 and I2 approximately match.

Thus conventional reference circuit 65 generates reference current $I_{ref}$ and first output circuit 70 generates first output current I1 that replicates $I_{ref}$. Second output circuit 80 outputs second output current I2, a replica of first output current I1, to load 85.

In the first embodiment of the present invention, the current density of PMOS transistor 32 approximately matches the current density of PMOS transistor 31. Similarly, the current density of NMOS transistor 33 approximately matches the current density of transistor 30. PMOS transistor 32 has a large channel-width to channel-length ratio ("aspect ratio") relative to that of the NMOS transistor 33. In this embodiment the aspect ratio of PMOS transistor 32 is approximately 400:1 or 200:0.5, and the aspect ratio of NMOS transistor 33 is approximately 20:5.

Transistors 22 and 23 exhibit similar gate-to-source voltages because transistors 22 and 23 are matched in physical geometry, gate terminal 22*c* and gate terminal 23*c* are connected to node N46, and because source terminal 22*a* and source terminal 23*a* are connected to node N45. To improve the matching between the magnitudes of currents I1 and I2, transistors 22 and 23 should have similar drain-to-source voltages, (i.e., the voltages at nodes N47 and N48 should match). For best matching, transistors 22 and 23 should be located close to each other. Also, well known common centroid lay out techniques should be used to reject gradients.

Transistor 31 reduces a difference between the drain-to-source voltages of transistors 22 and 23, and thereby improves the matching between currents I1 and I2. In the first embodiment of the present invention, PMOS transistor 31 has an aspect ratio that matches the aspect ratio of PMOS transistor 32, i.e., 400/1 or 200/0.5. Increasing the aspect ratio of PMOS transistor 31 reduces the difference between the voltages at gate terminal 31*c* and source terminal 31*a* of PMOS transistor 31, namely the difference between the voltages at nodes N50 and N48, necessary to achieve a level of current conduction through PMOS transistor 31. The large aspect ratio of PMOS transistor 31 thus allows current mirror 100A to provide a same level of second output current I2 at decreasing levels of supply voltage 95.

Biasing circuit 90 provides voltages at node N52 and node N50 that cause the second output current I2 to match first output current I1. Current I3 is necessary to begin the operation of biasing circuit 90. In this embodiment, current I3 is approximately the same value as first output current I1. Current I3 can also be scaled larger than or less than the value of first output current I1. The voltage at node N47, $V_{N47}$, is represented by the gate-to-source voltage of transistor 30, $V_{GS_30}$. The voltage at node N48, $V_{N48}$, is represented by the following equation:

$$V_{N48}=V_{N52}-V_{SG_32}+V_{SG_31}$$

where $V_{N52}$ represents the voltage at node N52;

$V_{SG_32}$ represents the source to gate voltage of PMOS transistor 32; and $V_{SG_31}$ represents the source to gate voltage of PMOS transistor 31.

Voltages $V_{SG_32}$ and $V_{SG_31}$ approximately match each other because PMOS transistor 32 has approximately the same current density as PMOS transistor 31. Thus $V_{N48}$ equals $V_{N52}$. The voltage $V_{N52}$ is equal to the gate to source voltage of NMOS transistor 33, $V_{GS_33}$. So, $V_{N48}$ equals $V_{GS_33}$. Since NMOS transistor 33 has approximately the same current density as transistor 30, voltage $V_{GS_33}$ approximately equals voltage $V_{GS_32}$ and so $V_{N48}$ approximately equals $V_{N47}$. Consequently, second output current I2 should approximately match first output current I1.

Thus the biasing circuit 90 provides a voltage at node N52 and a voltage at node N50 such that second output current I2 into load 85 substantially matches first output current I1 even at low voltages of supply voltage 95. In this embodiment, first output current I1 will match I2 where I1 ranges from $0^4$.001 to 10 mA.

Figure 1:
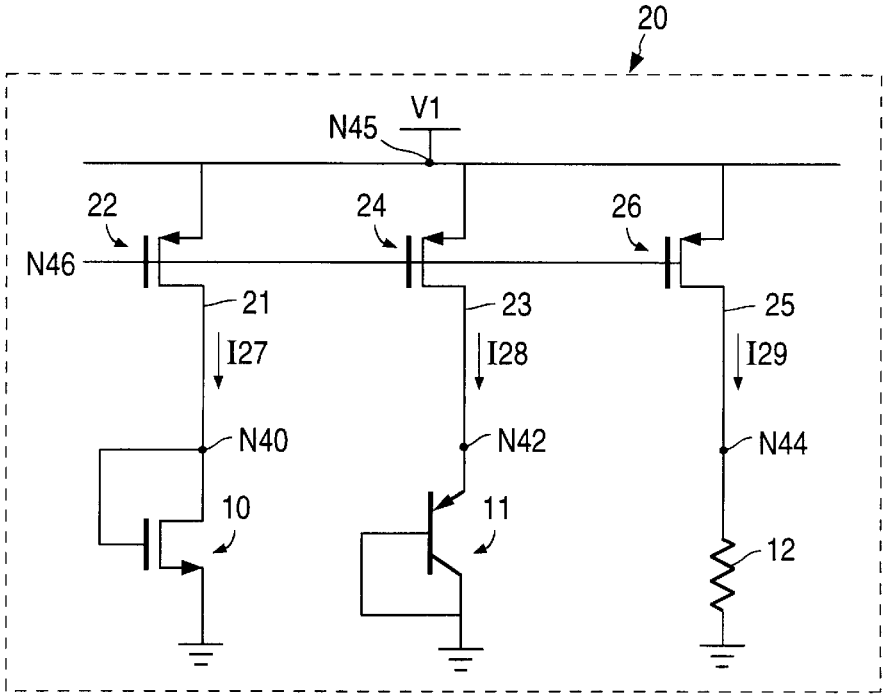
FIG. 1 (PRIOR ART)
FIG. 1 illustrates a current source 20 of the prior art having different load devices connected to output branches thereof.
Figure 2:
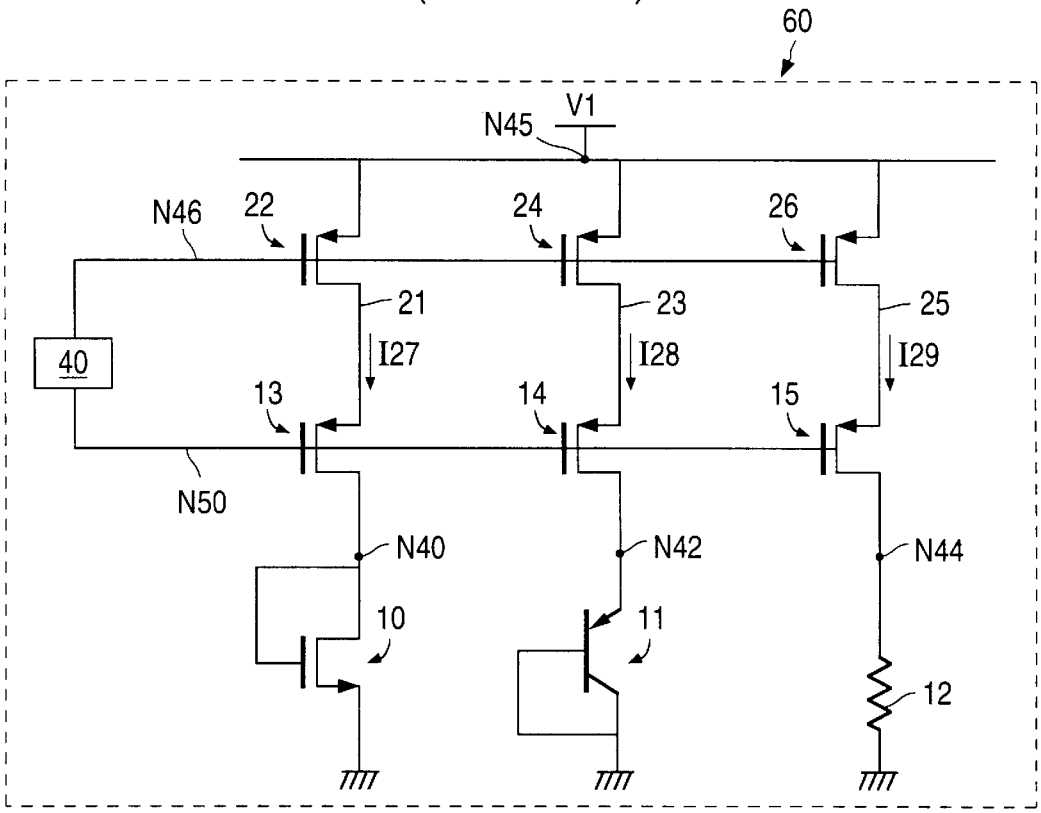
FIG. 2 (PRIOR ART)
FIG. 2 illustrates a cascoded current source 60 as known in the prior art.

In the current source 60 of FIG. 2, each branch is coupled in a cascode configuration including transistors 13, 14, and 15. In contrast, in this embodiment of the present invention, only a voltage of second output circuit 80 is controlled by extra cascode circuitry. Therefore less voltage is used in second output circuit 80 than in the current source 60.

Figure 3B:
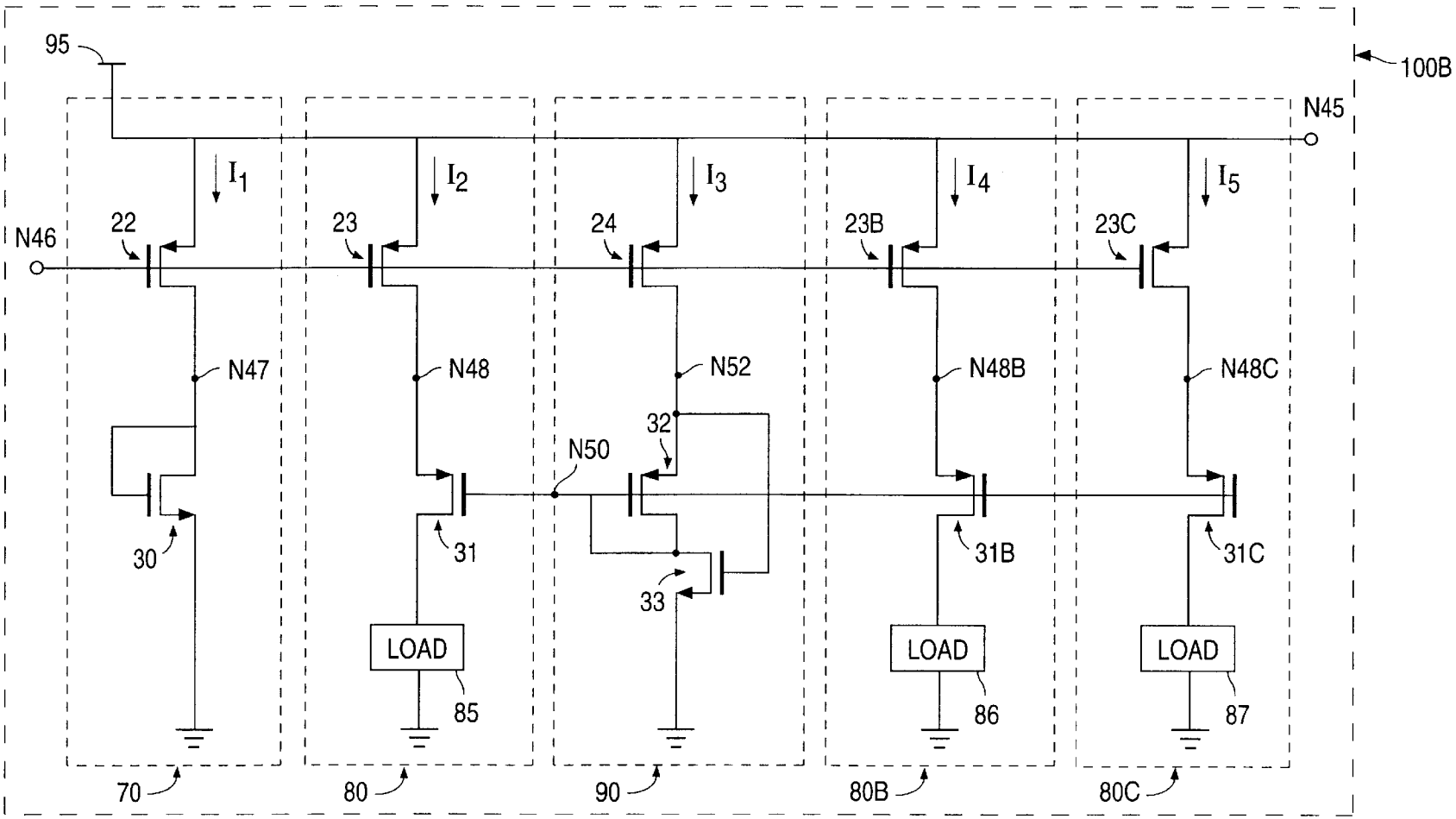
FIG. 3B illustrates an embodiment of the present invention depicted in FIG. 3A with additional current generating circuits 80B and 80C.

Additional currents may be generated which match first output current I1. For example, FIG. 3B depicts current source 100B with currents I4 and I5 generated using two replicas of second output circuit 80, circuits 80B and 80C. Not depicted in FIG. 3B is conventional reference circuit 65 of FIG. 3A. Transistors 23B and 23C are provided to be approximately the same size as transistor 23 or scaled to a larger or smaller size than transistor 23. Transistors 31B and 31C are approximately the same size as PMOS transistor 31 or scaled to a larger or smaller size than PMOS transistor 31. Consequently, currents I4 and I5 approximately match currents I2 and I1 because voltages at nodes N48B, N48C, N48, and N47 approximately match.

A second embodiment of the present invention provides a current source that is the same as current source 100A of the first embodiment of the present invention except the aspect ratio of PMOS transistor 31 is slightly larger than the aspect ratio of PMOS transistor 32. A suitable aspect ratio of PMOS transistor 31 is approximately 440/1. Increasing the aspect ratio of PMOS transistor 31 allows the voltage at node N48 to match the voltage at N47 even for increasing voltages at node N49. The higher aspect ratio of PMOS transistor 31 makes the voltage at source terminal 31*a*, node N48, less sensitive to increasing voltages at drain terminal 31*b*, node N49. Thus matching of currents I1 and I2 can be maintained for increasing voltages at node N49.

The first or second embodiments of the present invention may be used in temperature sensors, low voltage band gap references, or other bias circuits where a low supply voltage is provided and currents must be generated which match a reference current. For example, temperature sensor and band gap circuits include a "Current Proportional to Absolute Temperature" (IPTAT) circuit and a "Current Proportional to Voltage-Base-Emitter" (IPTVBE) circuit.

Figure 4A:
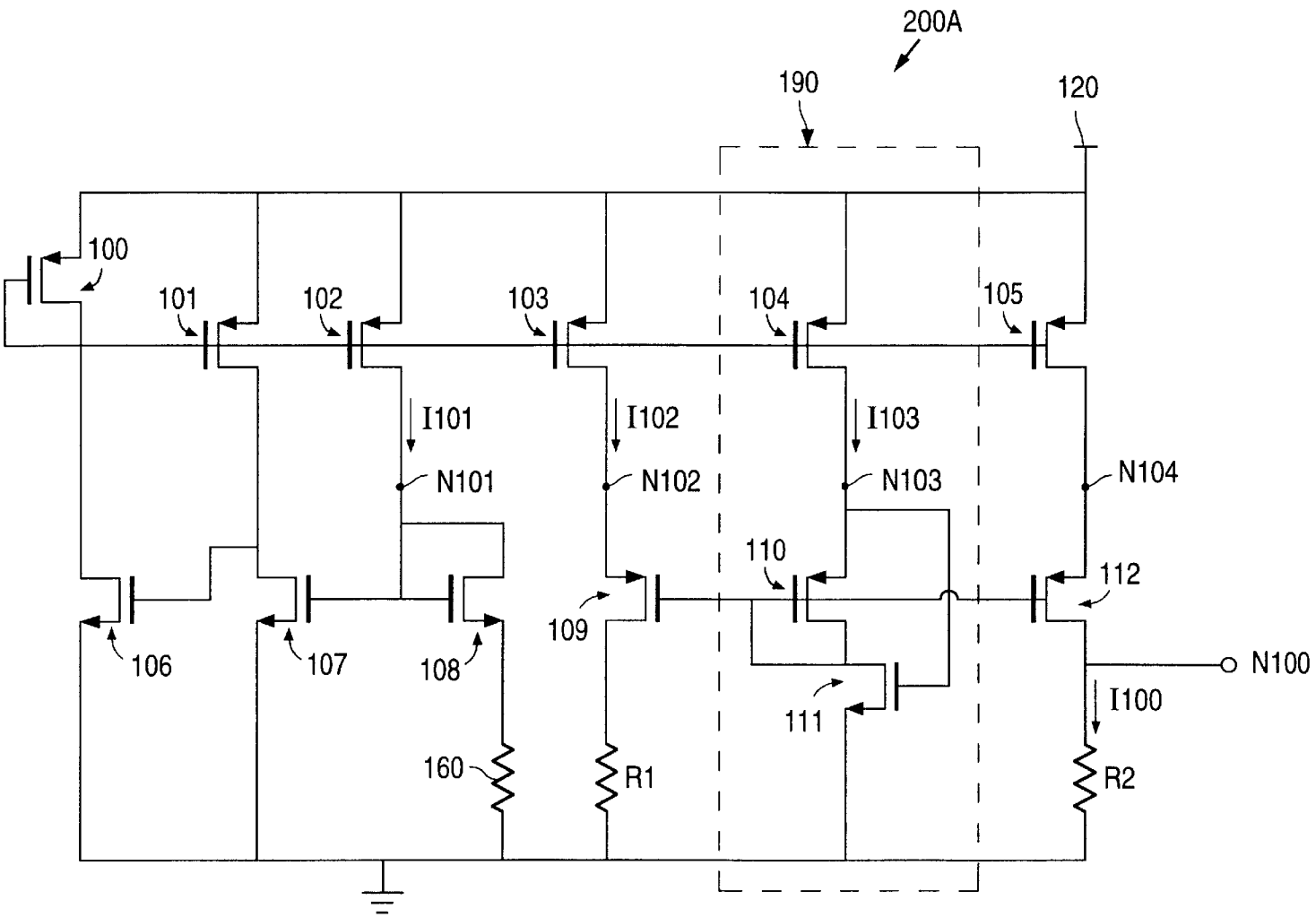
FIG. 4A illustrates an IPTAT generator circuit 200A, a possible use of embodiments of the present invention.
Figure 4B:
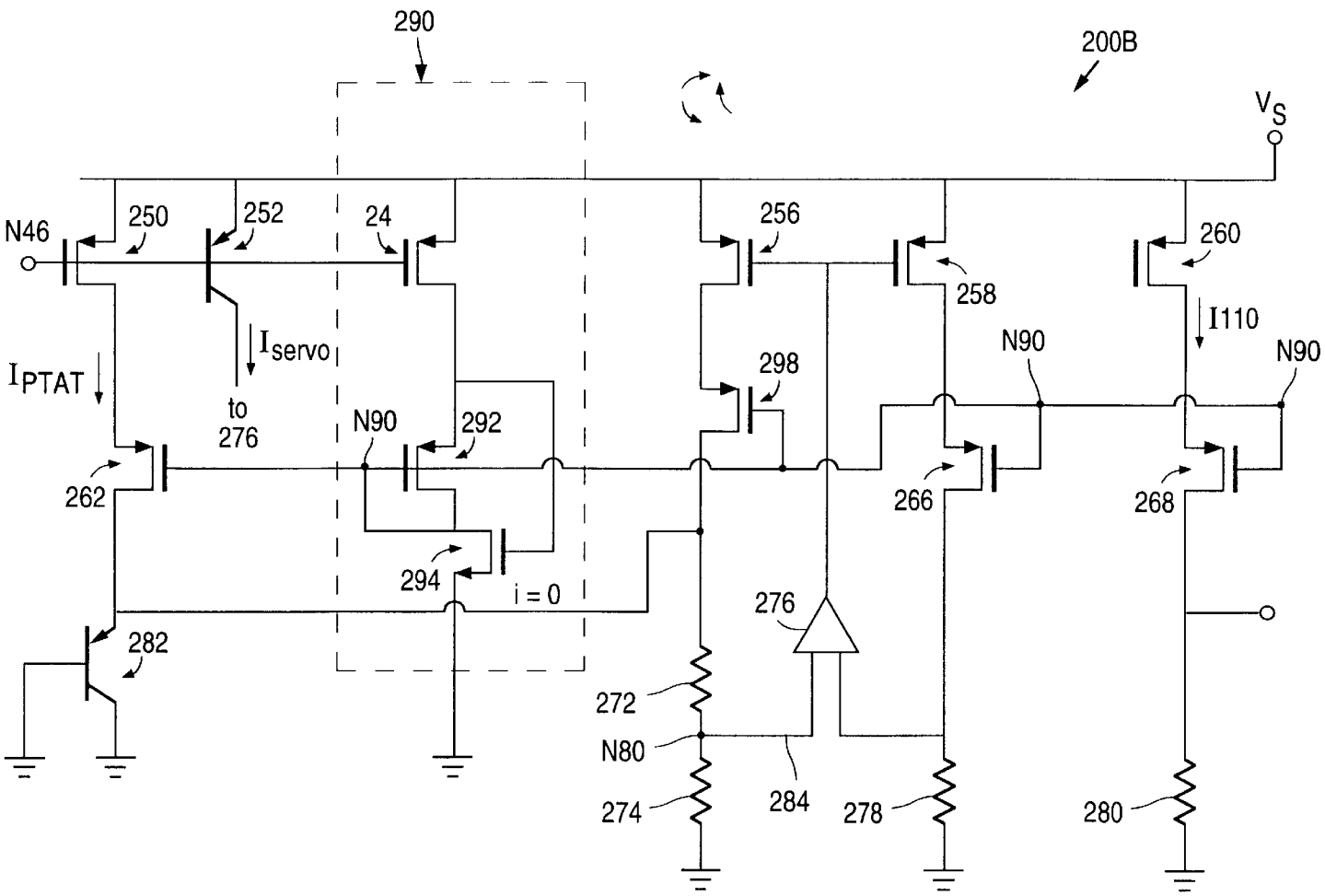
FIG. 4B depicts IPTVBE generator circuit 200B, a possible use of embodiments of the present invention.

FIG. 4A depicts a suitable IPTAT circuit 200A. FIG. 4B depicts a suitable IPTVBE circuit 200B. IPTAT circuit 200A of FIG. 4A provides an output voltage and current to node N100. Current I100 increases with increasing temperature of IPTAT circuit 200A. IPTVBE circuit 200B of FIG. 4B generates current I110. Current I110 decreases with increasing temperature of IPTVBE circuit 200B. A temperature sensing circuit measures and subtracts the difference between current I100 of IPTAT circuit 200A and current I110 of IPTVBE circuit 200B. A band gap circuit sums currents I100 and I110.

Where the first embodiment of the present invention is used in IPTAT generator circuit 200A of FIG. 4A, transistors 107 and 111 have the same current density. Transistors 109, 110, and 112 have the same current density, transistors 101–105 have the same current density. Transistor 108 has a current density that is 1/10 or 1/20 times the current density of transistor 107. Resistor 160 is 9 kiloohms where transistor 108 has 1/10 times the current density of transistor 107 and 18 kiloohms where transistor 108 has 1/20 times the current density of transistor 107. This is consistent with a 90 mV per decade change for modern transistors. Biasing circuit 190 causes the voltages at nodes N101 and N104 to match so that currents I101 and I100 match one another.

Where the second embodiment of the present invention is used in IPTAT generator circuit 200A, transistors 109 and 112 have a slightly larger current density than transistor 110. Transistors 109 and 112 have a current density of 5 to 10 lower than the current density of transistor 110. IPTAT generator circuit 200A matches currents I102 and I100 even where resistors R1 and R2 provide high voltages.

IPTVBE generator circuit 200B of FIG. 4B includes biasing circuit 290 similar to biasing circuit 90 described earlier with respect to FIG. 3A. Where the first embodiment of the present invention is used in IPTVBE generator circuit 200B, the aspect ratio and current density of transistor 292 of biasing circuit 290 matches the aspect ratio and current density of PMOS transistors 262, 266, 268, and 298. Thus biasing circuit 290 cancels systematic variations in the threshold voltages of PMOS transistors 262, 266, 268, and 298. Transistors 250, 256, 258, and 260 have the same aspect ratio and current density. Therefore, the current I110 matches current IPTAT because the gate to source voltages of PMOS transistors 268 and 262 match.

The input terminals of amplifier 276 are coupled to resistors 272, 274, and 278. Current $I_{servo}$ from transistor

252 power amplifier 276. Due to the coupling of input terminal 284 of amplifier 276 between resistor 272 and resistor 274, the voltage at the input terminal 284 can be lower than previously known. Thus amplifier 276 can operate at a low voltage provided at input terminal 284. A suitable value of resistor 272 is 400 kiloohms and suitable values of resistors 274 and 278 are 200 kiloohms. A suitable value of resistor 280 is 100 or 200 kiloohms.

When the second embodiment of the present invention is used in IPTVBE generator circuit 200B, the aspect ratio and current density of PMOS transistors 262, 266, 268, and 298 is slightly larger than the aspect ratio and current density of PMOS transistor 292 of biasing circuit 290. PMOS transistors 262, 266, 268, and 298 have a current density of 5 or 10% less than that of transistor 292. IPTVBE generator circuit 200B matches currents I110 and IPTAT even where transistor 282 and resistor 280 provide high voltages.

The foregoing description of the embodiments of the invention has been presented for purposes of illustration and description. It is nqt intended to be exhaustive or to limit the invention to the precise form disclosed. Numerous modifications or variations are possible in light of the above teachings. For example, the relationship between currents $I_{ref}$, I1, I2 can be varied by varying the size of transistors 21, 22, and 23. The MOS transistors can be replaced with BJT transistors. The embodiments were chosen and described to provide the best illustration of the principles of the invention and its practical application to thereby enable one of ordinary skill in the art to utilize the invention in various embodiments and with various modifications which are suited to the particular use contemplated.

What is claimed is:

1. A temperature sensing device comprising:

a "current proportional to absolute temperature" (IPTAT) circuit providing an first output voltage;

a "current proportional to Voltage-base-emitter" (IPTVBE) circuit providing a second output voltage; and a temperature-sensing output circuit providing a third output voltage proportional to a difference of said first output voltage and said second output voltage;

wherein one or more of said IPTAT circuit and said IPTVBE circuit includes a current mirror comprising:

a reference circuit providing a first reference voltage and a reference current;

a reference output circuit receiving said reference voltage and including a first current path having a current substantially a first predetermined multiple of said reference current, said first current path including a first electrical node;

a bias circuit receiving said first reference voltage and including a second current path having a current substantially said first predetermined multiple of said reference current, said second path including a second electrical node, said bias circuit configured such that said second electrical node has a voltage substantially identical to the voltage of said first electrical node; and an output circuit including a cascode transistor, said output circuit receiving said first reference voltage and connected in series said cascode transistor and said load to form a third current path in which is flowed a current of a second predetermined multiple of said reference current, said cascode transistor being controlled by said voltage of said second electrical node.

2. A bandgap device comprising:

a "current proportional to absolute temperature" (IPTAT) circuit providing an first output voltage;

a "current proportional to Voltage-base-emitter" (IPTVBE) circuit providing a second output voltage; and a bandgap output circuit providing a third output voltage proportional to a sum of said first output voltage and said second output voltage;

wherein one or more of said IPTAT circuit and said IPTVBE circuit includes a current mirror comprising:

a reference circuit providing a first reference voltage and a reference current;

a reference output circuit receiving said reference voltage and including a first current path having a current substantially a first predetermined multiple of said reference current, said first current path including a first electrical node;

a bias circuit receiving said first reference voltage and including a second current path having a current substantially said first predetermined multiple of said reference current, said second path including a second electrical node, said bias circuit configured such that said second electrical node has a voltage substantially identical to the voltage of said first electrical node; and an output circuit including a cascode transistor, said output circuit receiving said first reference voltage and connected in series said cascode transistor and said load to form a third current path in which is flowed a current of a second predetermined multiple of said reference current, said cascode transistor being controlled by said voltage of said second electrical node.

* * * * *